US009096408B2

(12) United States Patent
Tan

(10) Patent No.: US 9,096,408 B2
(45) Date of Patent: Aug. 4, 2015

(54) CLAM SHELL BAG DISPENSER

(76) Inventor: Daniel Brian Tan, Harahan, LA (US)

( * ) Notice: Subject to any disclaimer, the term of this patent is extended or adjusted under 35 U.S.C. 154(b) by 936 days.

(21) Appl. No.: 13/151,237

(22) Filed: Jun. 1, 2011

(65) Prior Publication Data

US 2012/0305618 A1 Dec. 6, 2012

(51) Int. Cl.
*B65H 35/10* (2006.01)

(52) U.S. Cl.
CPC ..... *B65H 35/10* (2013.01); *B65H 2402/43* (2013.01); *B65H 2701/191* (2013.01); *Y10T 225/247* (2013.01); *Y10T 225/393* (2013.01)

(58) Field of Classification Search
CPC ..... B65H 2402/43; B65H 35/10; A47F 9/042
USPC ..... 225/6, 106, 47
See application file for complete search history.

(56) References Cited

U.S. PATENT DOCUMENTS

| | | | | |
|---|---|---|---|---|
| 3,494,518 | A * | 2/1970 | Goss | 225/34 |
| 4,819,898 | A | 4/1989 | Benoit et al. | |
| 4,863,125 | A | 9/1989 | Bateman | |
| 4,915,460 | A | 4/1990 | Nook et al. | |
| 5,551,565 | A | 9/1996 | Kendrick | |
| 5,727,721 | A | 3/1998 | Guido et al. | |
| 6,089,514 | A * | 7/2000 | Huang et al. | 248/99 |
| 6,341,666 | B1 * | 1/2002 | Allen | 182/129 |
| 6,431,396 | B1 | 8/2002 | Daniels et al. | |
| 6,685,075 | B1 * | 2/2004 | Kannankeril | 225/96 |
| 7,128,251 | B1 | 10/2006 | Galle | |
| 7,270,256 | B2 * | 9/2007 | Daniels | 225/93 |
| 7,424,963 | B2 | 9/2008 | Daniels | |
| 7,591,405 | B2 | 9/2009 | Daniels | |
| 2002/0113109 | A1 * | 8/2002 | Gracyalny et al. | 225/5 |
| 2004/0007607 | A1 | 1/2004 | Daniels | |
| 2008/0128465 | A1 * | 6/2008 | Wilfong | 225/106 |
| 2011/0215128 | A1 * | 9/2011 | Greg | 225/1 |
| 2014/0166715 | A1 * | 6/2014 | Tan | 225/46 |

* cited by examiner

*Primary Examiner* — Ned Landrum
*Assistant Examiner* — Fernando Ayala
(74) *Attorney, Agent, or Firm* — David A. Belasco; Belasco Jacobs & Townsley, LLP

(57) ABSTRACT

A clamshell dispenser for film bags includes a planar base shaped to fit beneath a bag roll. Side travel limiters are attached to the base. A retaining bracket is hingedly mounted adjacent a front edge of the base to prevent the roll from moving outwardly from the dispenser when the bracket is latched. The bracket opens for introduction of the roll. An upward facing snagging hook engages either a chisel cut or a perforation in bags from the roll. A downward facing snagging hook may be attached to the retaining bracket. An adapter for a bin includes first and second bag dispensers mounted to a fixture. The fixture is shaped to fit within the bin. First and second axles are orthogonally attached to the fixture. The axles mount first and second positioning wheels that are located to slidably engage first and second integral channels in vertical sides of the bin.

29 Claims, 12 Drawing Sheets

FIG. 8B
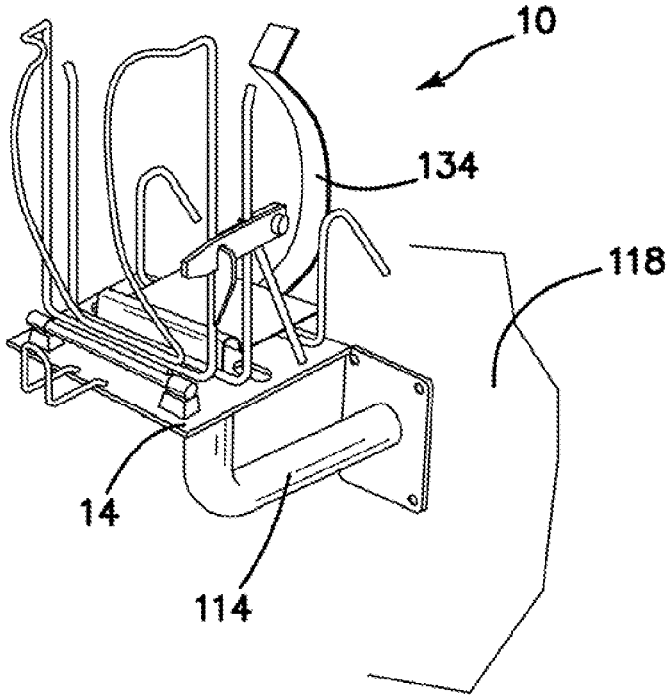
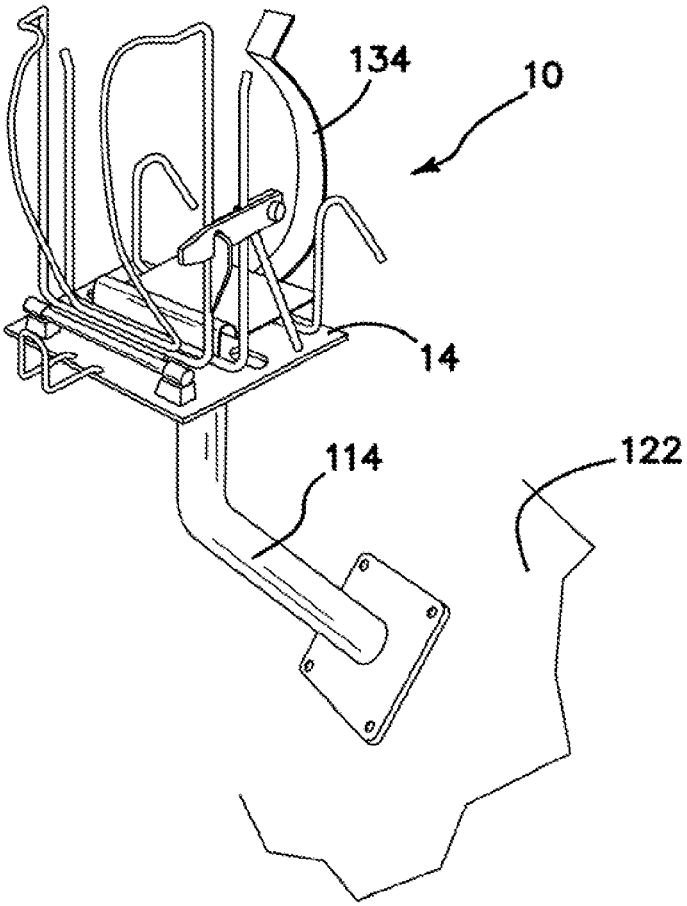
FIG. 8C

CLAM SHELL BAG DISPENSER

FIELD OF INVENTION

This invention relates to the field of plastic and other film bag storage and dispensing and more specifically to bag dispensers adapted to attach to a horizontal surface or a vertical surface using an existing wall mounted bin.

BACKGROUND OF THE INVENTION

In supermarkets and grocery stores space for the mounting of bag dispensers is usually at a premium. It is desirable to use as much of the space available as possible for the display of produce or the handling of other groceries. However, certain facilities must be provided to the store's customers and checkout personnel for efficient produce sales and merchandise handling. One such facility is the provision of produce bags that may be conveniently used by the customers to collect the produce that they wish to purchase. Another facility is a checkout counter that has a bag dispensing rack mounted into a vertical counter surface, thereby providing unencumbered horizontal counter space for the handling of the customer's merchandise. Ideally, the store would like to provide simple to use produce and merchandise bag dispensers that are easy to maintain, hold a large quantity of bags of a sufficient size and which do not require frequent servicing.

In addition, grocery stores would like to use space for the bag dispensers not readily usable for the display of produce or other merchandise. It is most convenient to display produce and other items on angled or substantially horizontal shelves. Vertical surfaces, such as the walls of display stands and shelves are good locations to position bag dispensers as such surfaces are not readily usable for other displays. Toward this end, some supermarket chains have developed standardized plastic bins that are installed into vertical and some horizontal surfaces. These bins are designed to accommodate a horizontal rod on which a large roll of produce bags is rotatably suspended. The present invention makes use of these standardized bins to make available larger stores of produce or merchandise bags to the shopping customer and checkout personnel.

U.S. Pat. No. 6,685,075, issued to Kannankeril, discloses a pivoting arm bag dispenser and bag dispensing system. This reference discloses a dispenser for serially dispensing plastic bags from a wound roll of plastic bags mounted around a core. The dispenser is a wire frame structure with a roll restraining means comprising side rails to prevent axial movement of bags roll. The roll of bags is rolled onto a hollow plastic core with a passageway therethrough that receives the U-shaped axial portion of the pivotable arm. The arm may be moved from a roll mounting position to a bag dispensing position. A tongue or double tongue is provided to assist in bag separation. The dispenser has a support member with a plurality of mounting holes which allows dispenser to be secured to a vertical wall or mounted to a support system.

U.S. Pat. No. 5,727,721, issued to Guido et al. is directed to a flexible web dispenser of a wire frame type that provides for the mounting of a roll of plastic bags and the dispensing of individual bags from that roll. The dispenser includes an outer frame and an inner frame that pivots within the outer frame so that the plastic bag to be dispensed may be pivoted into position from a loading position allowing the webbing jaws to draw together in a clamping action so as to frictionally engage the plastic web prior to the removal of an individual bag. The wire frame structure of the dispenser restricts the lateral motion of the roll of plastic bags and thus provides for the restraining of the roll for convenience and dispensing bags from said roll.

U.S. Pat. No. 6,089,514, issued to Huang et al. discloses a swing-arm bagging rack for supporting multiple styles of packs of plastic bags. The structure of the dispenser is of the wire frame type used to dispense plastic bags from a roll or a plurality of rolls of plastic bags with a swinging arm structure. Uprights may be fixed to the arm portion and comprise a short section of rod with a slightly enlarged head.

U.S. Pat. No. 4,819,898, issued to Benoit et al. is directed to a bag holding, dispensing, loading and discharge system. A clamp member is provided on a bar along with an upwardly-extending protrusion which provides a lock-like structure.

U.S. Pat. No. 4,915,460, issued to Nook et al. is directed to a security system for dispensing racks illustrating a latching structure for a dispenser rack.

U.S. Pat. Nos. 7,591,405, 7,424,963, and 7,270,256, issued to Daniels illustrate wire frame structures for roll mounted plastic bags.

U.S. Pat. No. 4,863,125, issued to Bateman discloses a flexible dispenser for film bags.

U.S. Patent Application No. 2008/0128465, published for Wilfong is directed to a recessed dispenser for plastic bags that may provide for more than one pack of plastic bags in a single dispenser.

It is an objective of the present invention to provide a compact system for dispensing plastic produce bags or merchandise bags. It is another objective to provide such dispensers that can be mounted to an adapter that can be removably installed in standardized plastic bins provided by grocery store owners. It is still another objective to provide such a system that can store an increased number of relatively large produce or merchandise bags in the standardized bin. It is yet another objective of the invention to provide a dispenser system that provides a visual indication when the bag pack needs to be replaced. It is a further objective to provide such a system that can be easily fabricated from existing dispenser and other mechanical components. It is yet a further objective to provide a dispenser system that cannot be loaded incorrectly. Finally, it is an objective of the present invention to provide such a system that is durable, inexpensive and simple to service.

While some of the objectives of the present invention are disclosed in the prior art, none of the inventions found include all of the requirements identified.

SUMMARY OF THE INVENTION

The present invention addresses all of the deficiencies of prior art dispensers for roll mounted film bags and satisfies all of the objectives described above.

(1) A clamshell dispenser for roll mounted film bags providing the desired features may be constructed from the following components. A planar base is provided. The base is sized and shaped to fit beneath a roll of film bags and has a first side and a second side. At least one first side travel limiter is provided. The first side limiter is attached to the planar base adjacent the first side and limits movement of the roll of film bags toward the first side. At least one second side travel limiter is provided. The second side limiter is attached to the planar base adjacent the second side and limits movement of the roll of film bags toward the second side.

A bag roll tray is provided. The bag roll tray has a vertical portion. The vertical portion is attached to the planar base. A U-shaped portion extends from the vertical portion and is spaced apart from the planar base. A horizontal portion extends from the U-shaped portion and is spaced above the planar base. The bag roll tray is sized and shaped to fit between the at least one first side travel limiter and the at least one second side travel limiter. The U-shaped portion is in contact with the horizontal portion forming a concave shape to accept a lower surface of a bag roll, thereby stabilizing the roll in the dispenser.

A retaining bracket is provided. The retaining bracket is hingedly mounted adjacent a front edge of the planar base and is sized and shaped to prevent the roll of film bags from moving outwardly from the dispenser when the bracket is located in a first, upper position. The retaining bracket is movable to a second, lower position for introduction of the roll into the dispenser. An upward facing snagging hook is provided. The snagging hook is sized and shaped to engage either a chisel cut or a perforation in a film bag from the roll of film bags as the bag is withdrawn from the dispenser.

(3) In another variant, a latching mechanism is provided. The latching mechanism secures the retaining bracket in the first upper position.

(4) In yet another variant, the latching mechanism includes a protruding tab and a latch. The tab is affixed to the retaining bracket. The latch is pivotally mounted to one of the at least one first side travel limiter or the at least one second side travel limiter. The latch has a notch. The notch is sized and shaped to removably engage the protruding tab.

(5) In still another variant, the retaining bracket further includes a spring. The spring urges the bracket toward the first, upper position.

(6) In yet another variant, a bag stream guide is provided. The guide is attached to the retaining bracket.

(7) In a further variant, a second, downward facing snagging hook is provided. The second hook is attached to the retaining bracket.

(8) In still a further variant, the planar base is attached to a fixture for mounting to a horizontal surface.

(9) In yet a further variant, the planar base is attached to a fixture for mounting to either of a vertical or angled surface.

(10) In another variant of the invention, the planar base further includes at least one aperture for mounting the base to a fixture.

(11) In still another variant, the retaining bracket is curved to reduce a height of the dispenser.

(12) In yet another variant, at least one of the at least one first side travel limiter and at least one the at least one second side travel limiter is curved to reduce a height of the dispenser.

(13) In a further variant, a rearward motion limiter is provided. The rearward motion limiter is attached to the planar base.

(14) In still a further variant, the rearward motion limiter is a member that extends upwardly from a point adjacent a rear edge of the planar base.

(15) In yet a further variant, at least one of the at least one first side travel limiter and the at least one second side travel limiter is curved outwardly from either of the first side and the second side of the planar base, respectively, to assist in insertion of the roll of film bags.

(16) In another variant of the invention, at least one upper end of the retaining bracket is curved outwardly from a center of the planar base to assist in insertion of the roll of film bags into the dispenser.

(17) In still another variant, an upper end of the rearward motion limiter is curved outwardly from the rear edge of the planar base to assist in insertion of the roll of film bags into the dispenser.

(18) An adapter for a bin is provided. The bin has a support enclosure for a roll of film bags. The bin has a half round cylindrical wall and first and second vertical side walls. A supporting rim is provided. The rim is located orthogonally to front edges of the side walls and upper and lower edges of the cylindrical wall. The rim has spaced apertures for mounting the bin to a surface. The surface has an opening sized and shaped to permit passage of outer surfaces of the walls but not the supporting rim. The vertical side walls have first and second integral channels. The channels provide an entry point and support for either a rod, the rod is sized and shaped to support the roll of bags in the bin, or an adapter for a bin.

The adapter comprises first and second bag dispensers for folded roll mounted film bags, each of the dispensers comprises a planar base. The base has a first side and a second side and is sized and shaped to fit beneath a roll of the film bags and is mounted to a fixture. At least one first side travel limiter is provided. The first side limiter is attached to the planar base adjacent the first side and limits movement of the roll of film bags toward the first side. At least one second side travel limiter is provided. The second side limiter is attached to the planar base adjacent the second side and limits movement of the roll of film bags toward the second side.

A bag roll tray is provided. The bag roll tray has a vertical portion. The vertical portion is attached to the planar base. A U-shaped portion extends from the vertical portion and is spaced apart from the planar base. A horizontal portion extends from the U-shaped portion and is spaced above the planar base. The bag roll tray is sized and shaped to fit between the at least one first side travel limiter and the at least one second side travel limiter, the U-shaped portion in contact with the horizontal portion forming a concave shape to accept a lower surface of a bag roll, thereby stabilizing the roll in the dispenser.

A retaining bracket is provided. The retaining bracket is hingedly mounted adjacent a front edge of the planar base and is sized and shaped to prevent the roll of film bags from moving outwardly from the dispenser when the bracket is disposed in a first, upper position. The retaining bracket is movable to a second, lower position for introduction of the roll into the dispenser. An upward facing snagging hook is provided. The snagging hook is sized and shaped to engage either of a chisel cut and a perforation in a film bag from the roll of film bags as the bag is withdrawn from the dispenser.

The fixture comprises a planar surface. The surface is sized and shaped to fit at least partially within the bin. A first axle is provided. The first axle is mounted orthogonally adjacent a first side edge of the fixture. A second axle is provided. The second axle is mounted orthogonally adjacent a second side edge of the fixture. The first axle is mounted coaxially with the second axle. First and second positioning wheels are provided. The positioning wheels are mounted to the first and second axles and located to slidably engage the first and second integral channels with a bottom surface of the fixture located adjacent a lower portion of the cylindrical wall of the bin.

(19) In a variant of the invention, the dispensers further include at least one aperture penetrating the planar base for mounting the base to the fixture.

(21) In still another variant, the dispensers further include a bag roll tray. The bag roll tray is a sized and shaped to fit between the at least one first side travel limiter and the at least one second side travel limiter. The bag roll tray has a concave shape to accept a lower surface of a bag roll. As the roll decreases in diameter through removal of bags, the bag roll tray stabilizes the roll on the dispenser.

(22) In a further variant, the dispensers further include a latching mechanism. The latching mechanism secures the retaining bracket in the first upper position.

(23) In yet another variant, the latching mechanism includes a protruding tab and a latch. The tab is affixed to the retaining bracket. The latch is pivotally mounted to one of the at least one first side travel limiter or the at least one second side travel limiter. The latch has a notch. The notch is sized and shaped to removably engage the protruding tab.

(24) In a further variant, the retaining bracket further includes a spring. The spring urges the bracket toward the first, upper position.

(25) In still a further variant, the dispensers further include a bag stream guide. The guide is attached to the retaining bracket.

(26) In yet a further variant, the dispensers further include a second, downward facing snagging hook. The second hook is attached to the retaining bracket.

(27) In another variant of the invention, the retaining bracket is curved to reduce a height of the dispenser.

(28) In still another variant, at least one of the at least one first side travel limiter and at least one of the at least one second side travel limiter is curved to reduce a height of the dispenser.

(29) In yet another variant, the dispensers further include a rearward motion limiter. The rearward motion limiter is attached to the planar base.

(30) In a further variant, the rearward motion limiter is a member that extends upwardly from a point adjacent a rear edge of the planar base.

(31) In still a further variant, a bracket is provided. The bracket is sized and shaped to secure the adapter to the bin.

(32) In a final variant of the invention, the bracket is an angled, rigid member sized and shaped to bear upon an upper surface of the fixture.

An appreciation of the other aims and objectives of the present invention and an understanding of it may be achieved by referring to the accompanying drawings and the detailed description of a preferred embodiment.

DESCRIPTION OF THE DRAWINGS

FIG. 8A-8C are perspective views of the FIG. 1 embodiment attached to fixtures for attachment to horizontal, vertical and angled surfaces, respectively;

DETAILED DESCRIPTION OF THE PREFERRED EMBODIMENT (1) FIGS. 1-12 illustrate a clamshell dispenser for roll mounted film bags 10 providing the desired features that may be constructed from the following components. As illustrated in FIGS. 1-4, 8, 11 and 12, a planar base 14 is provided. The base 14 is sized and shaped to fit beneath a roll 18 of film bags 22 and has a first side 26 and a second side 30. At least one first side travel limiter 34 is provided. The first side limiter 34 is attached to the planar base 14 adjacent the first side 26 and limits movement of the roll 18 of film bags 22 toward the first side 26. At least one second side travel limiter 38 is provided. The second side limiter 38 is attached to the planar base 14 adjacent the second side 30 and limits movement of the roll 18 of film bags 22 toward the second side 30.

Figure 1:
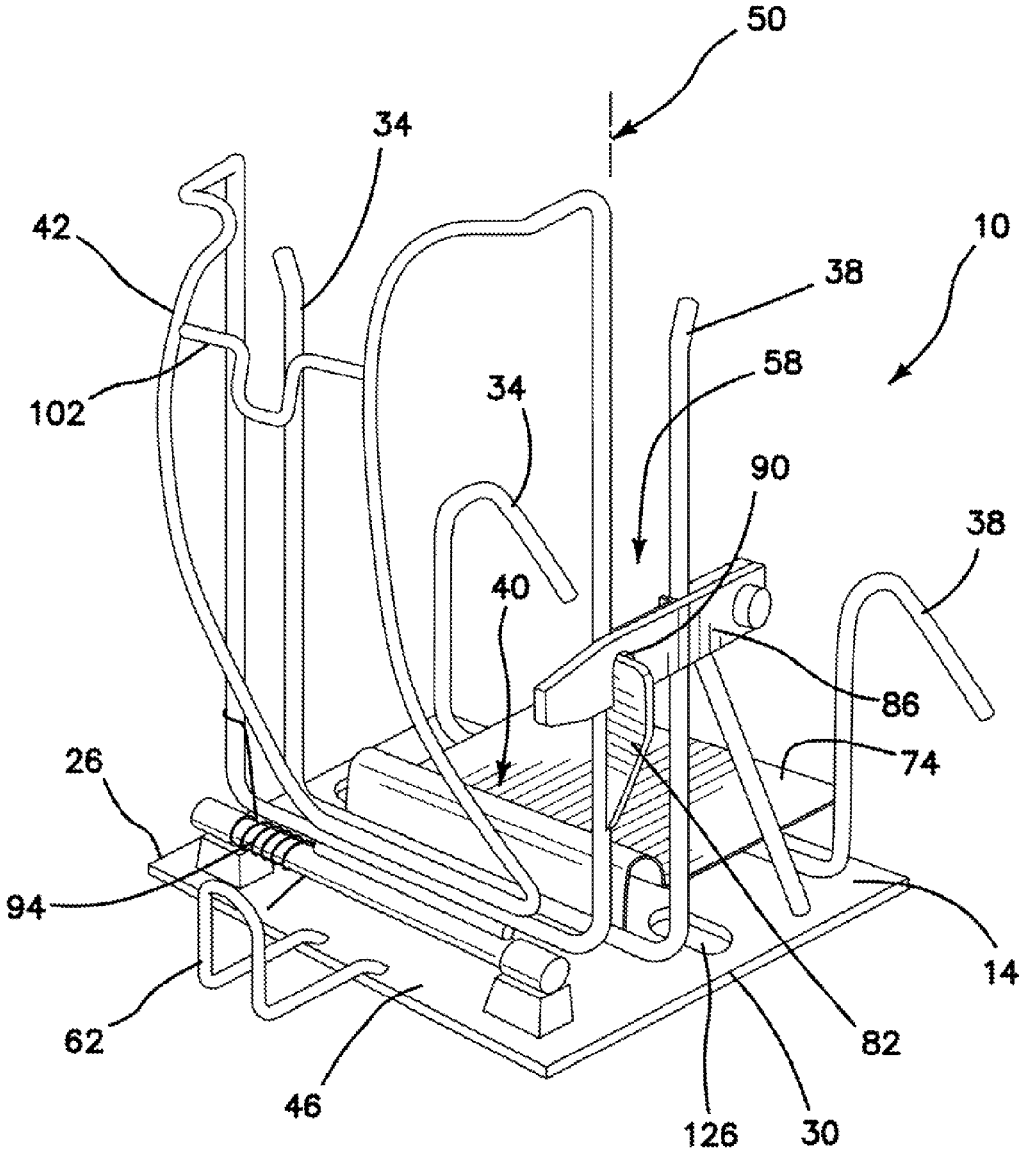
FIG. 1 is a perspective view of the preferred embodiment of the invention illustrating a curved retaining bracket in an upper, closed position.

A bag roll tray 74 is provided. The bag roll tray 74 has a vertical portion 76. The vertical portion 76 is attached to the planar base 14. A U-shaped portion 80 extends from the vertical portion 76 and is spaced apart from the planar base 14. A horizontal portion 84 extends from the U-shaped portion 80 and is spaced above the planar base 14. The bag roll tray 74 is sized and shaped to fit between the at least one first side travel limiter 34 and the at least one second side travel limiter 38. The U-shaped portion 80 is in contact with the horizontal portion 84 forming a concave shape 40 to accept a lower surface 78 of a bag roll 18, thereby stabilizing the roll 18 in the dispenser 10.

Figure 9:
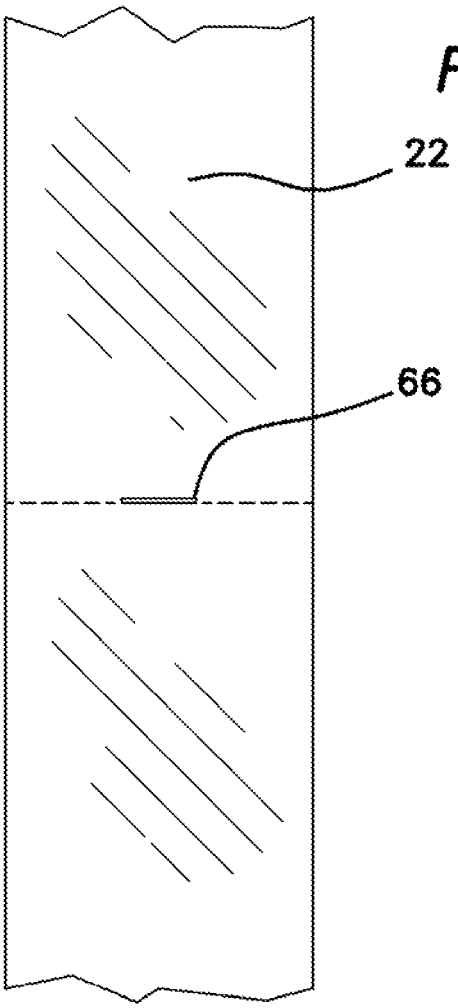
FIG. 9 is a plan view of roll mounted bags illustrating a chisel cut and perforation joining the bags.
Figure 10:
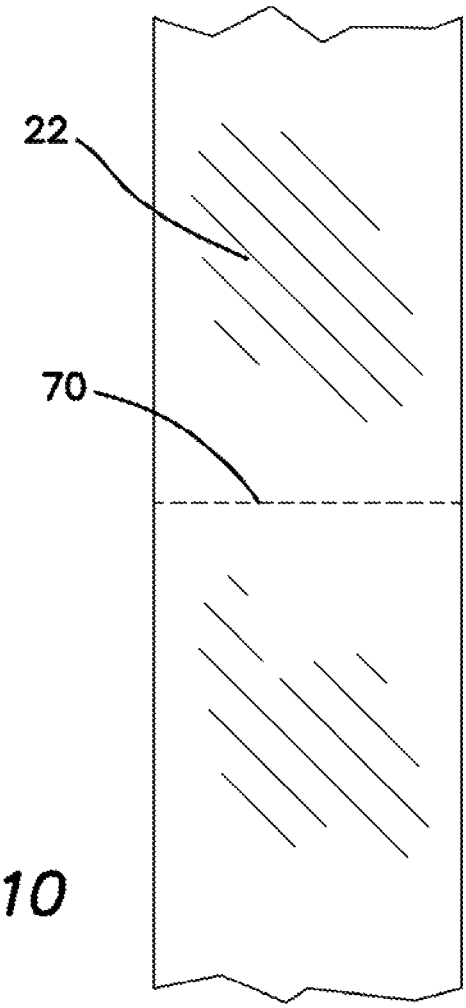
FIG. 10 is a plan view of roll mounted bags illustrating a perforation joining the bags.

A retaining bracket 42 is provided. The retaining bracket 42 is hingedly mounted adjacent a front edge 46 of the planar base 14 and is sized and shaped to prevent the roll 18 of film bags 22 from moving outwardly from the dispenser 10 when the bracket 42 is located in a first, upper position 50. The retaining bracket 42 is movable to a second, lower position 54 for introduction of the roll 18 into the dispenser 10. An upward facing snagging hook 62 is provided. The snagging hook 62 is sized and shaped to engage either a chisel cut 66 or a perforation 70 in a film bag 22 from the roll 18 of film bags 22 as the bag 22 is withdrawn from the dispenser 10, as illustrated in FIGS. 9 and 10.

(3) In another variant, a latching mechanism 58 is provided. The latching mechanism 58 secures the retaining bracket 42 in the first upper position 50.

(4) In yet another variant, the latching mechanism 58 includes a protruding tab 82 and a latch 86. The tab 82 is affixed to the retaining bracket 42. The latch 86 is pivotally mounted to one of the at least one first side travel limiter 34 or the at least one second side travel limiter 38. The latch 86 has a notch 90. The notch 90 is sized and shaped to removably engage the protruding tab 82.

Figure 2:
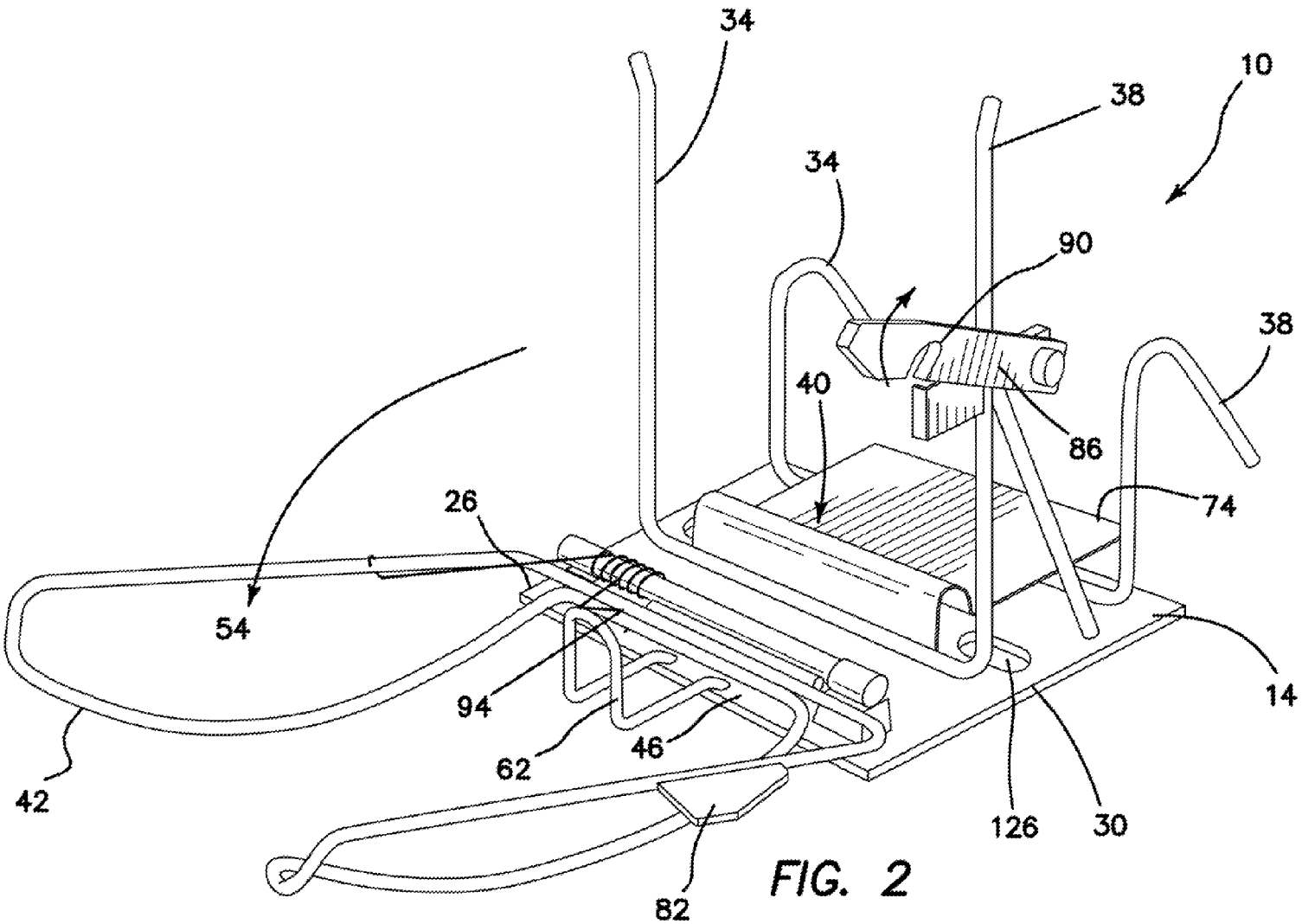
FIG. 2 is a perspective view of the FIG. 1 embodiment of the invention illustrating the curved retaining bracket in a lower, open position.
Figure 3:
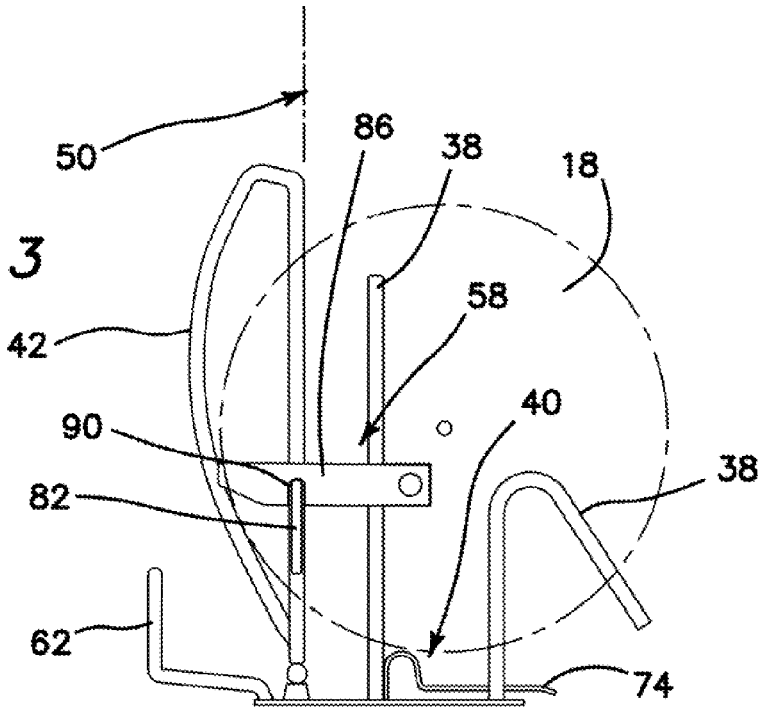
FIG. 3 is a side elevational view of the FIG. 1 embodiment with a bag roll loaded and the curved retaining bracket in the upper, closed position.
Figure 4:
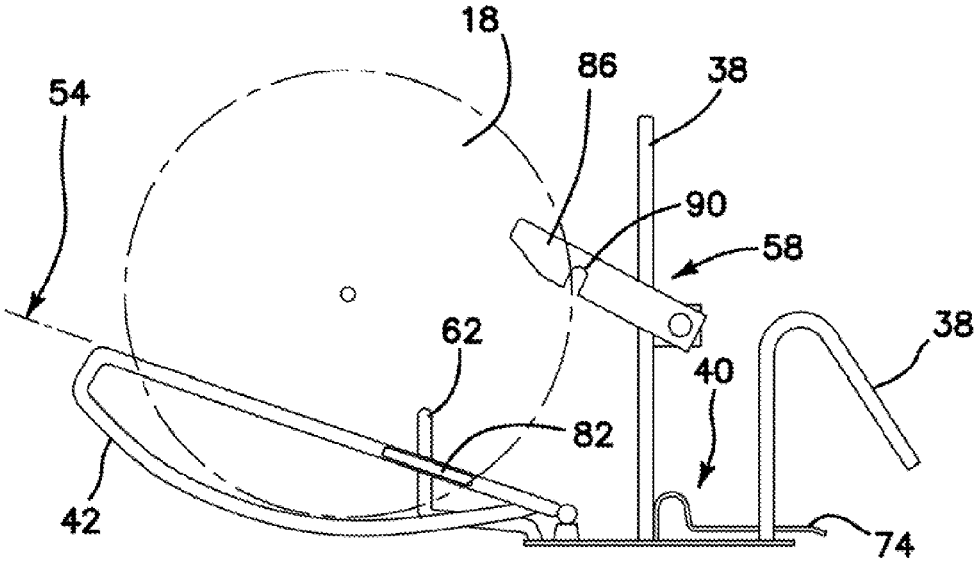
FIG. 4 is a side elevational view of the FIG. 1 embodiment with a bag roll being loaded and the curved retaining bracket in the lower, open position.

(5) In still another variant, as illustrated in FIGS. 1 and 2, the retaining bracket 42 further includes a spring 94. The spring 94 urges the bracket 42 toward the first, upper position 50.

Figure 8A:
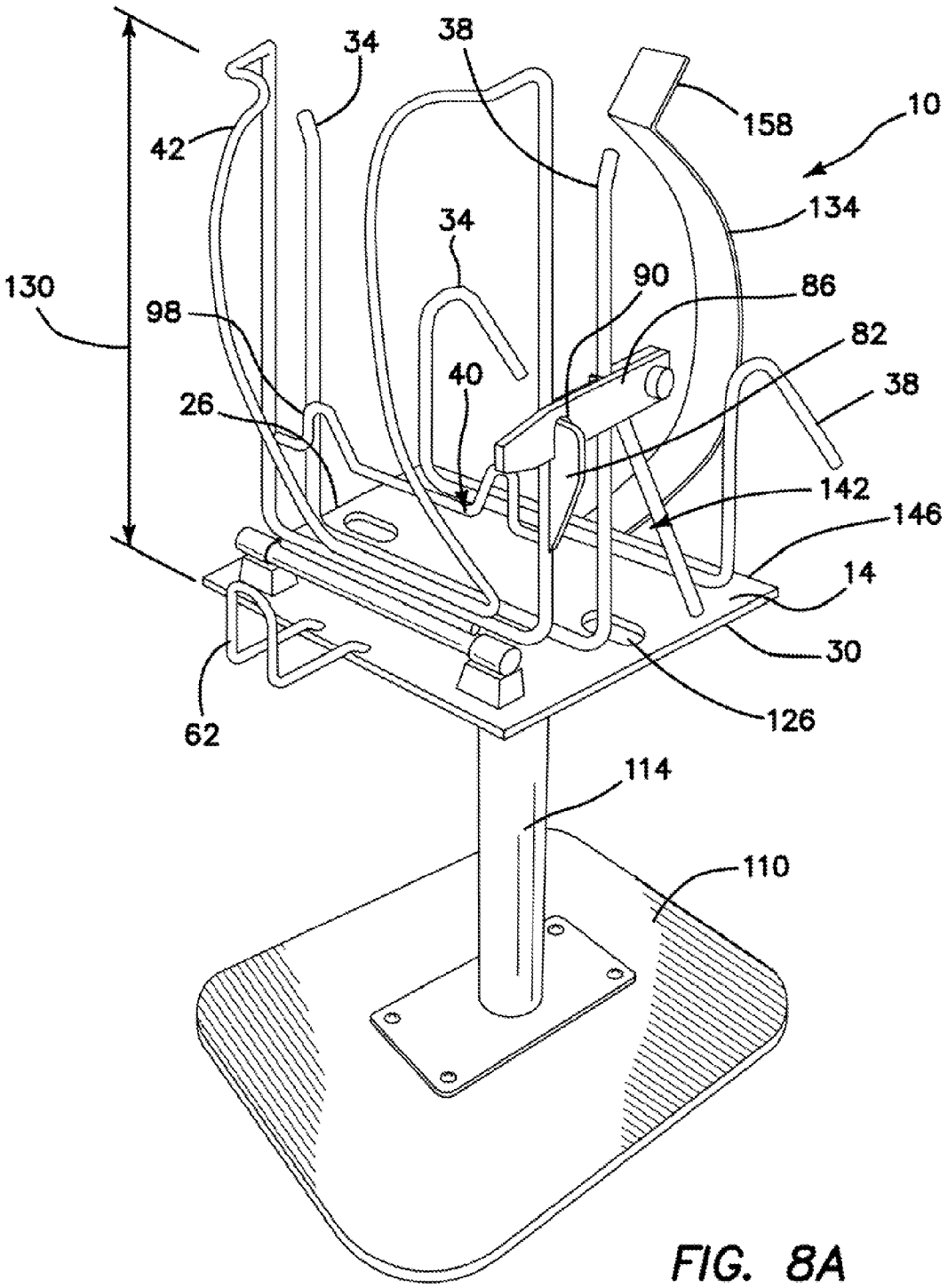

(6) In yet another variant, as illustrated in FIG. 8A, a bag stream guide 98 is provided. The guide 98 is attached to the retaining bracket 42.

(7) In a further variant, as illustrated in FIG. 1, a second, downward facing snagging hook 102 is provided. The second hook 92 is attached to the retaining bracket 42.

(8) In still a further variant, as illustrated in FIG. 8A, the planar base 14 is attached to a fixture 114 for mounting to a horizontal surface 110.

(9) In yet a further variant, as illustrated in FIGS. 8B and 8C, the planar base 14 is attached to a fixture 114 for mounting to either of a vertical 118 or angled 122 surface.

(10) In another variant of the invention, as illustrated in FIGS. 1, 2 and 8A-8C, the planar base 14 further includes at least one aperture 126 for mounting the base 14 to a fixture 114.

(11) In still another variant, the retaining bracket 42 is curved to reduce a height 130 of the dispenser 10.

(12) In yet another variant, at least one of the at least one first side travel limiter 34 and at least one the at least one second side travel limiter 38 is curved to reduce a height 130 of the dispenser 10.

(13) In a further variant, as illustrated in FIGS. 8A-8C, a rearward motion limiter 134 is provided. The rearward motion limiter 134 is attached to the planar base 14.

(14) In still a further variant, the rearward motion limiter 134 extends upwardly from a point 142 adjacent a rear edge 146 of the planar base 14.

Figure 11:
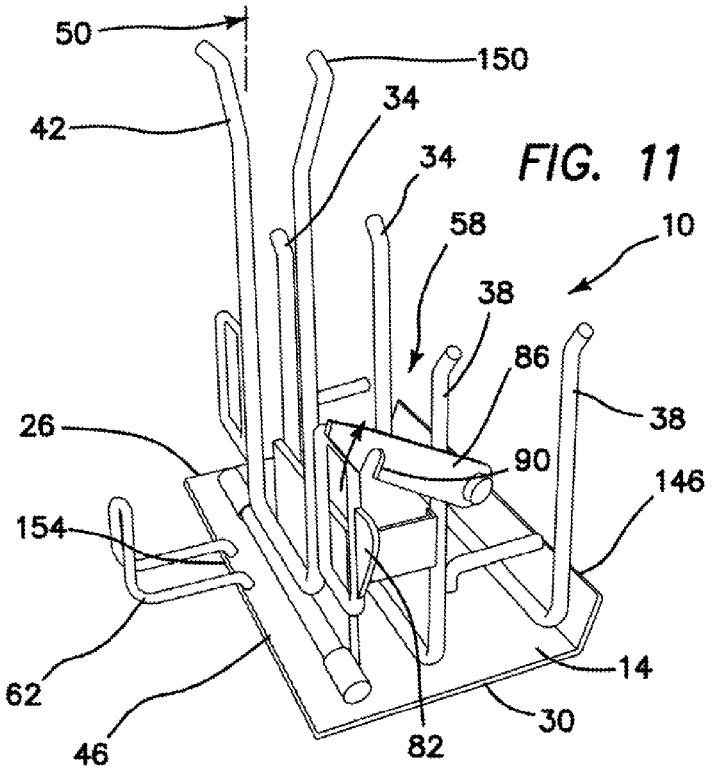
FIG. 11 is a perspective view of another embodiment of the dispenser illustrating a retaining bracket without a height reducing curve, shown in a first, upper position.
Figure 12:
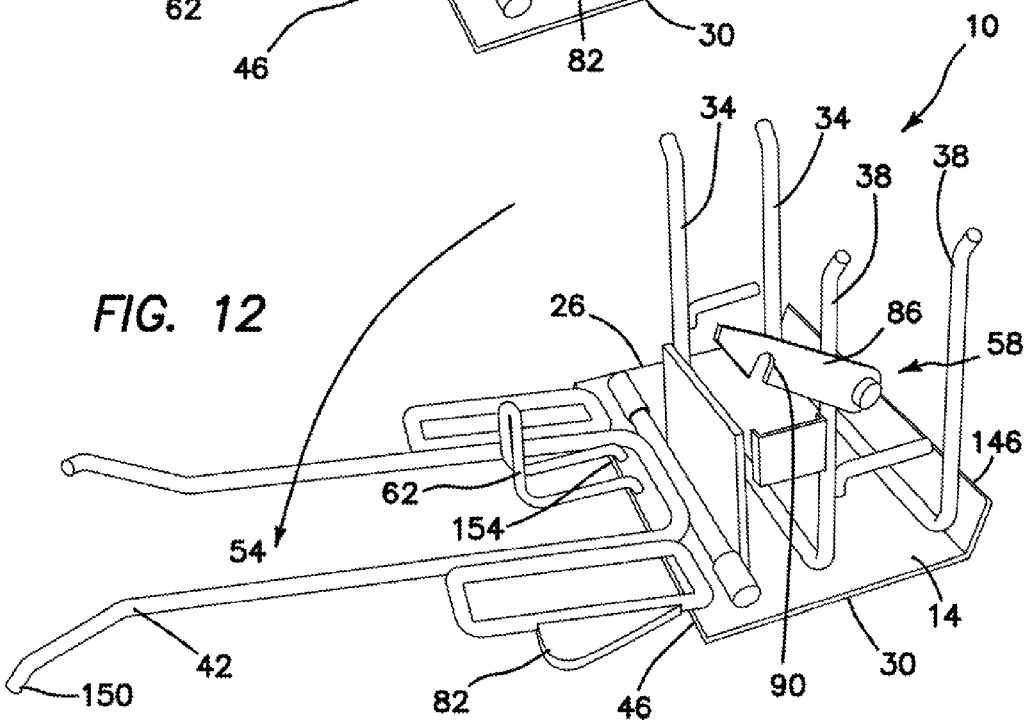
FIG. 12 is a perspective view of the FIG. 11 embodiment illustrating the retaining bracket without a height reducing curve, shown in a second, lower position.

(15) In yet a further variant, as illustrated in FIGS. 11 and 12, at least one of the at least one first side travel limiter 34 and the at least one second side travel limiter 38 is curved outwardly from either of the first side 26 and the second side 30 of the planar base 14, respectively, to assist in insertion of the roll 18 of film bags 22.

(16) In another variant of the invention, at least one upper end 150 of the retaining bracket 42 is curved outwardly from a center 154 of the planar base 14 to assist in insertion of the roll 18 of film bags 22 into the dispenser 10.

(17) In still another variant, as illustrated in FIGS. 8A-8C, an upper end 158 of the rearward motion limiter 134 is curved outwardly from the rear edge 146 of the planar base 14 to assist in insertion of the roll 18 of film bags 22 into the dispenser 10.

(18) As illustrated in FIGS. 5, 6 and 7A-7D, an adapter for a bin 162 includes a support enclosure bin 166 for a roll 18 of film bags 22. The bin 166 has a half round cylindrical wall 170 and first 174 and second 178 vertical side walls. A supporting rim 182 is provided. The rim 182 is located orthogonally to front edges 186 of the side walls 174, 178 and upper 184 and lower 188 edges of the cylindrical wall 170. The rim 182 has spaced apertures 190 for mounting the bin 166 to a surface 194. The surface 194 has an opening 198 sized and shaped to permit passage of outer surfaces 202 of the walls 170, 174, 178 but not the supporting rim 182. The vertical side walls 174, 178 have first 206 and second 210 integral channels. The channels 206, 210 provide an entry point and support for either a rod 222, the rod 222 is sized and shaped to support the roll 18 of bags 22 in the bin 166, or an adapter for a bin 162.

The adapter 162 comprises first 10 and second 10 bag dispensers for folded roll mounted film bags 22, each of the dispensers 10 comprises a planar base 14. The base 14 has a first side 26 and a second side 30 and is sized and shaped to fit beneath a roll 18 of the film bags 22 and is mounted to a fixture 106. At least one first side travel limiter 34 is provided. The first side limiter 34 is attached to the planar base 14 adjacent the first side 26 and limits movement of the roll 18 of film bags 22 toward the first side 26. At least one second side travel limiter 38 is provided. The second side limiter 38 is attached to the planar base 14 adjacent the second side 30 and limits movement of the roll 18 of film bags 22 toward the second side 30.

A bag roll tray 74 is provided. The bag roll tray 74 has a vertical portion 76. The vertical portion 76 is attached to the planar base 14. A U-shaped portion 80 extends from the vertical portion 76 and is spaced apart from the planar base 14. A horizontal portion 84 extends from the U-shaped portion 80 and is spaced above the planar base 14. The bag roll tray 74 is sized and shaped to fit between the at least one first side travel limiter 34 and the at least one second side travel limiter 38. The U-shaped portion 80 is in contact with the horizontal portion 84 forming a concave shape 40 to accept a lower surface 78 of a bag roll 18, thereby stabilizing the roll 18 in the dispenser 10.

A retaining bracket 42 is provided. The retaining bracket 42 is hingedly mounted adjacent a front edge 46 of the planar base 14 and is sized and shaped to prevent the roll 18 of film bags 22 from moving outwardly from the dispenser 10 when the bracket 42 is located in a first, upper position 50. The retaining bracket 42 is movable to a second, lower position 54 for introduction of the roll 18 into the dispenser 10. An upward facing snagging hook 62 is provided. The snagging hook 62 is sized and shaped to engage either a chisel cut 66 or a perforation 70 in a film bag 22 from the roll 18 of film bags 22 as the bag 22 is withdrawn from the dispenser 10, as illustrated in FIGS. 9 and 10.

The fixture 106 includes a planar surface 108. The surface 108 is sized and shaped to fit at least partially within the bin 166. A first axle 226 is provided. The first axle 226 is mounted orthogonally adjacent a first side edge 230 of the fixture 106. A second axle 234 is provided. The second axle 234 is mounted orthogonally adjacent a second side edge 238 of the fixture 106. The first axle 226 is mounted coaxially with the second axle 234. First 242 and second 246 positioning wheels are provided. The positioning wheels 242, 246 are mounted to the first 226 and second 234 axles and are located to slidably engage the first 206 and second 210 integral channels with a bottom surface 250 of the fixture 106 located adjacent a lower portion 254 of the cylindrical wall 170 of the bin 166.

(19) In a variant of the invention, the dispensers further include at least one aperture penetrating the planar base for mounting the base to the fixture.

(20) In another variant, the dispensers 10 further include at least one first side travel limiter 34. The first side limiter 34 is attached to the planar base 14 adjacent the first side 26 and limits movement of the roll 18 of film bags 22 toward the first side 26. At least one second side travel limiter 38 is provided. The second side limiter 38 is attached to the planar base 14 adjacent the second side 30 and limits movement of the roll 18 of film bags 22 toward the second side 30.

A retaining bracket 42 is provided. The retaining bracket 42 is hingedly mounted adjacent a front edge 46 of the planar base 14 and is sized and shaped to prevent the roll 18 of film bags 22 from moving outwardly from the dispenser 10 when the bracket 42 is located in a first, upper position 50. The retaining bracket 42 is movable to a second, lower position 54 for introduction of the roll 18 into the dispenser 10. An upward facing snagging hook 62 is provided. The snagging hook 62 is sized and shaped to engage either a chisel cut 66 or a perforation 70 in a film bag 22 from the roll 18 of film bags 22 as the bag 22 is withdrawn from the dispenser 10.

(21) In still another variant, the dispensers further include a bag roll tray 74. The bag roll tray 74 is sized and shaped to fit between the at least one first side travel limiter 34 and the at least one second side travel limiter 38 and has a concave shape 40 shaped to accept a lower surface 78 of a bag roll 18. As the roll 18 decreases in diameter through removal of bags 22, the bag roll tray 74 stabilizes the roll 18 in the dispenser.

(22) In a further variant, the dispensers further include a latching mechanism 58 is provided. The latching mechanism 58 secures the retaining bracket 42 in the first upper position 50.

(23) In yet another variant, the latching mechanism 58 includes a protruding tab 82 and a latch 86. The tab 82 is affixed to the retaining bracket 42. The latch 86 is pivotally mounted to one of the at least one first side travel limiter 34 or the at least one second side travel limiter 38. The latch 86 has a notch 90. The notch 90 is sized and shaped to removably engage the protruding tab 82.

(24) In a further variant, the retaining bracket 42 further includes a spring 94. The spring 94 urges the bracket 42 toward the first, upper position 50.

(25) In still a further variant, the dispensers 10 further include a bag stream guide 98. The guide 98 is attached to the retaining bracket 42.

(26) In yet a further variant, the dispensers 10 further include a second, downward facing snagging hook 92. The second hook 92 is attached to the retaining bracket 42.

(27) In another variant of the invention, the retaining bracket 42 is curved to reduce a height 130 of the dispenser 10.

(28) In still another variant, at least one of the at least one first side travel limiter 34 and at least one the at least one second side travel limiter 38 is curved to reduce a height 130 of the dispenser 10.

(29) In yet another variant, as illustrated in FIGS. 8A-C, the dispensers further include a rearward motion limiter 134. The rearward motion limiter 134 is attached to the planar base 14.

(30) In a further variant, the rearward motion limiter 134 extends upwardly from a point 142 adjacent a rear edge 146 of the planar base 14.

Figure 5:
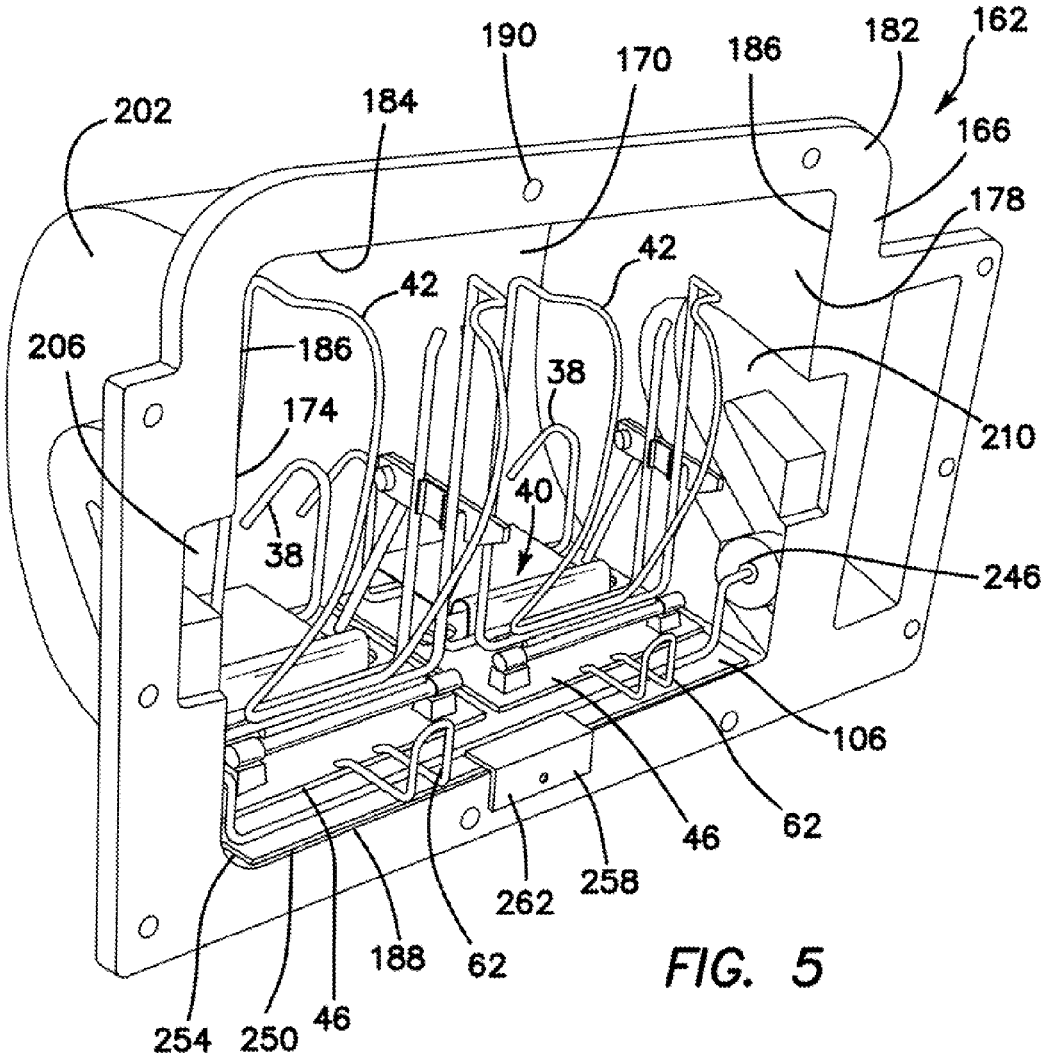
FIG. 5 is a perspective view of a bin, an adapter for the bin with two of the FIG. 1 embodiment dispensers attached.
Figure 6:
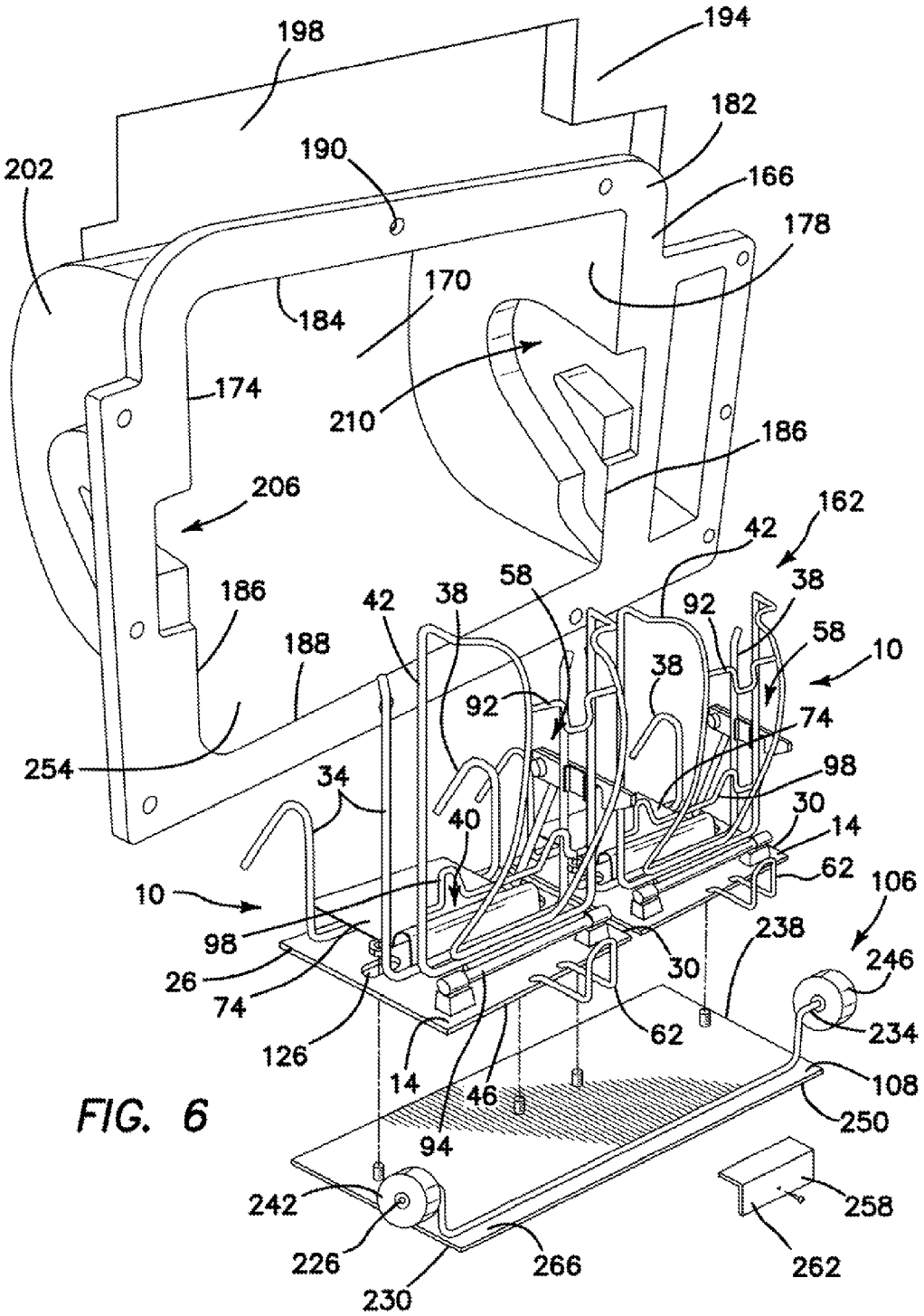
FIG. 6 is an exploded perspective view of the FIG. 5 embodiment.
Figure 6A:
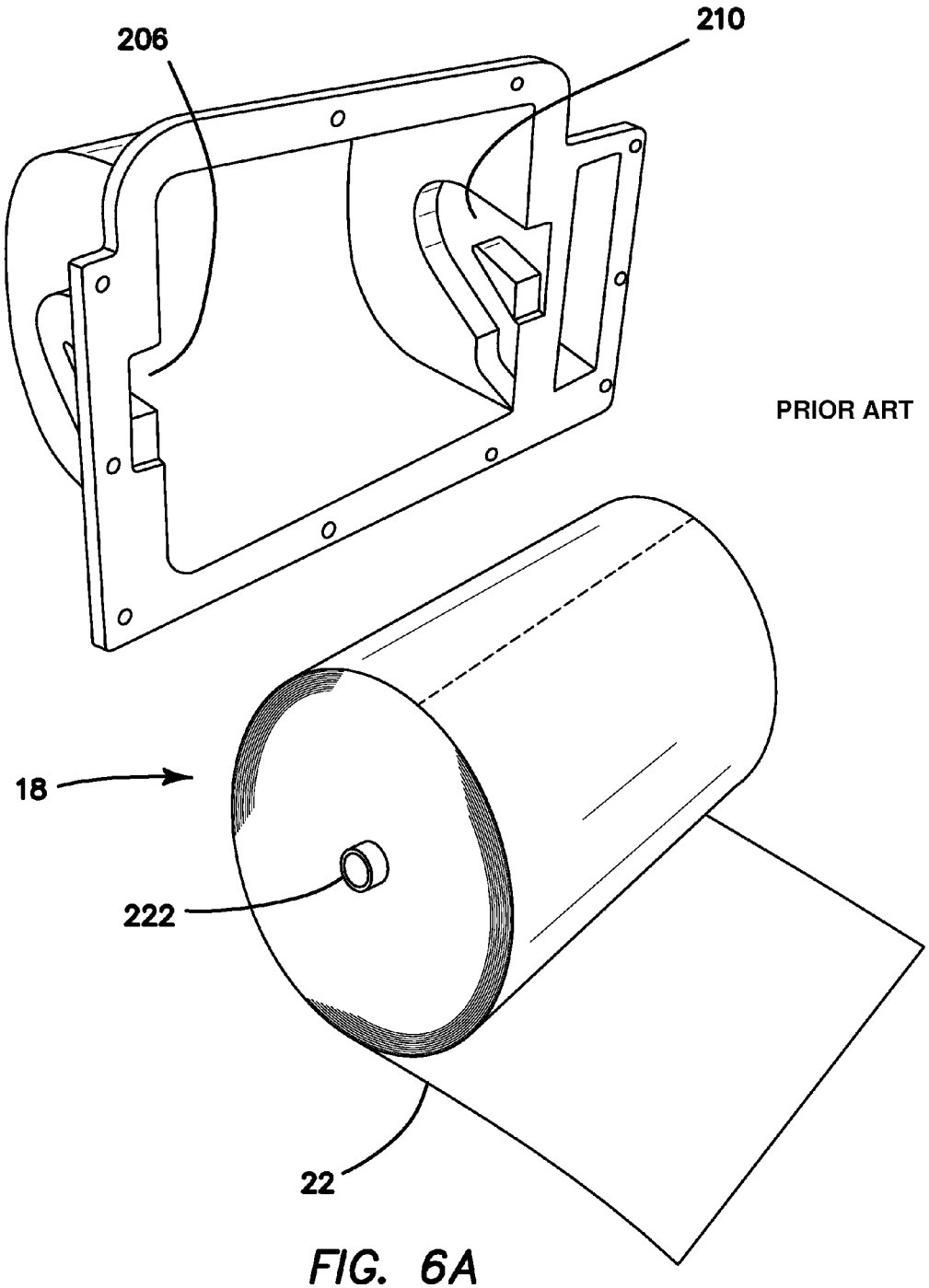
FIG. 6A is a perspective view of the prior art bin and full width bag roll mounted on a rod.
Figure 7A:
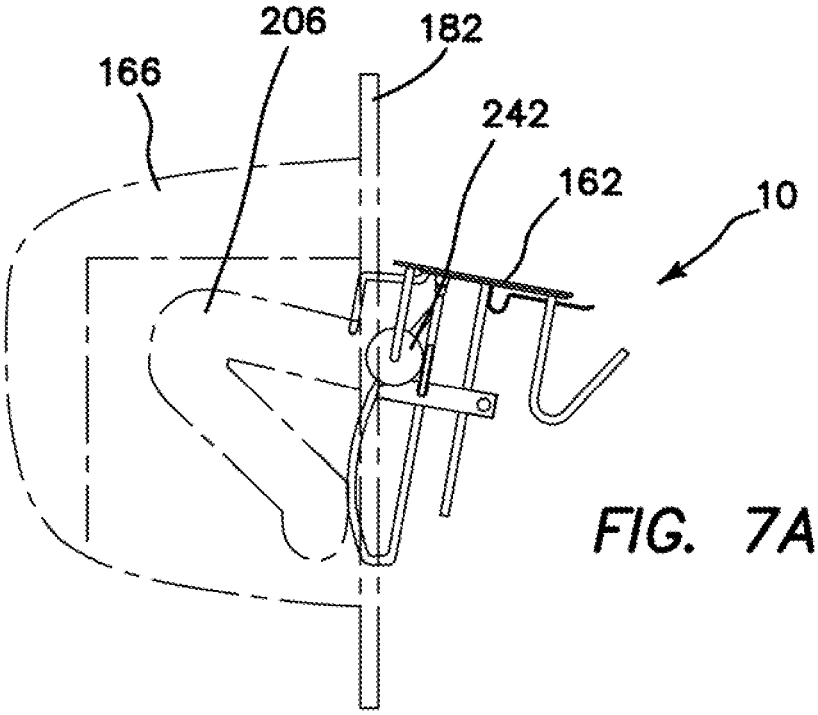
FIGS. 7A-7D are side elevational views of the adapter for the bin with attached dispensers being installed into the bin.
Figure 7B:
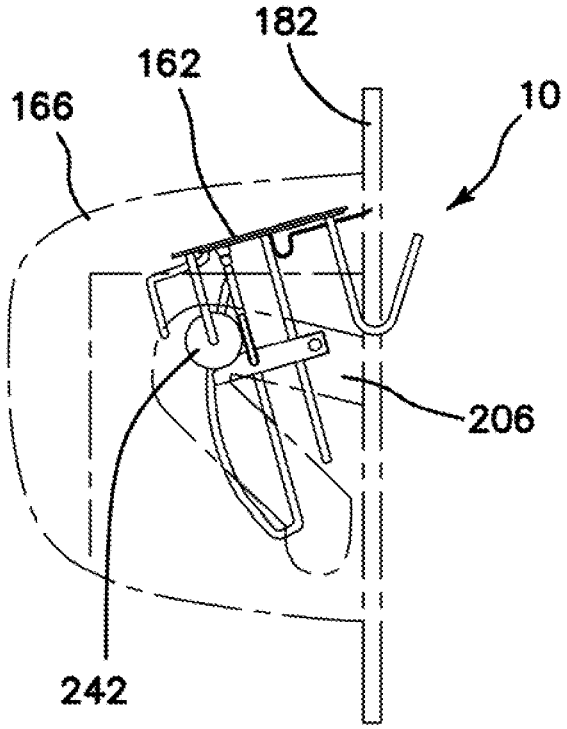
Figure 7C:
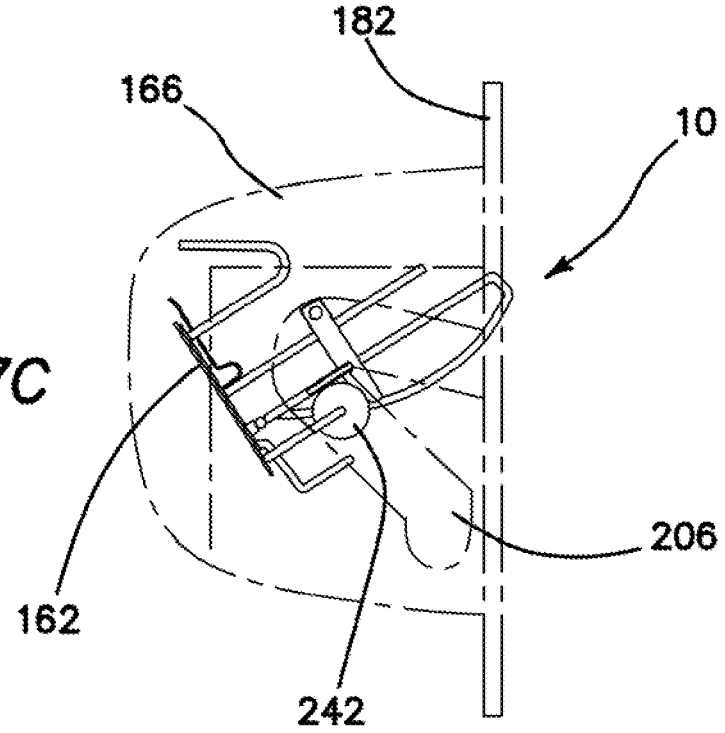
Figure 7D:
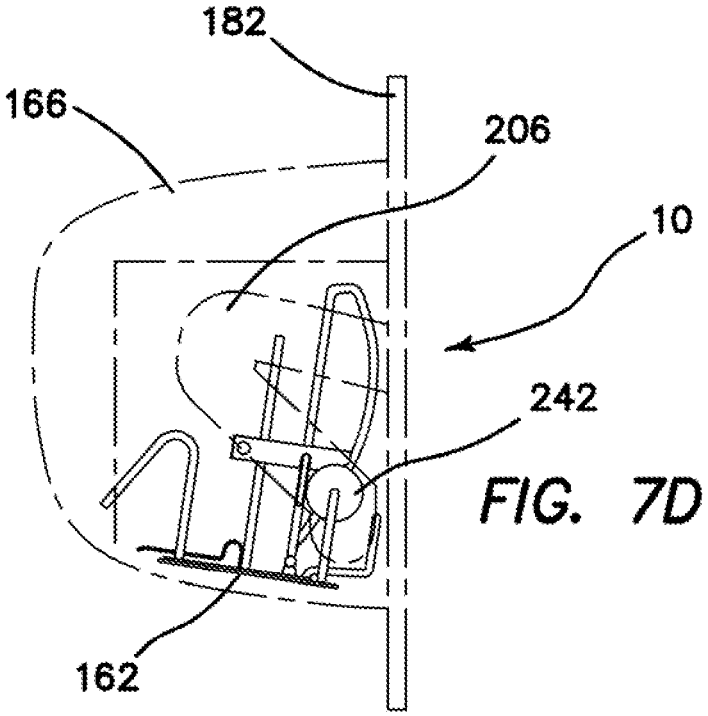

(31) In still a further variant, as illustrated in FIGS. 5 and 6, a bracket 258 is provided. The bracket 258 is sized and shaped to secure the adapter 162 to the bin 166.

(32) In a final variant of the invention, the bracket 258 is an angled, rigid member 262 sized and shaped to bear upon an upper surface 266 of the fixture 106.

The clamshell dispenser for roll mounted film bags 10 and adapter for a bin 162 have been described with reference to particular embodiments. Other modifications and enhancements can be made without departing from the spirit and scope of the claims that follow.

The invention claimed is:

1. A clamshell dispenser for roll mounted film bags, comprising:

a planar base, said base being sized and shaped to fit beneath a roll of film bags and having a first side and a second side;

at least one first side travel limiter, said first side limiter attached to said planar base adjacent said first side and limiting movement of said roll of film bags toward said first side;

at least one second side travel limiter, said second side limiter attached to said planar base adjacent said second side and limiting movement of said roll of film bags toward said second side;

a bag roll tray, said bag roll tray having a vertical portion, said vertical portion being attached to said planar base, a U-shaped portion extending from said vertical portion and spaced apart from said planar base and a horizontal portion extending from said U-shaped portion and spaced above said planar base, said bag roll tray being sized and shaped to fit between said at least one first side travel limiter and said at least one second side travel limiter, said U-shaped portion in contact with said horizontal portion forming a concave shape to accept a lower surface of a bag roll, thereby stabilizing said roll in said dispenser;

a retaining bracket, said retaining bracket being hingedly mounted adjacent a front edge of said planar base and being sized and shaped to prevent said roll of film bags from moving outwardly from said dispenser when said bracket is disposed in a first, upper position;

said retaining bracket being movable to a second, lower position for introduction of said roll into said dispenser; and an upward facing snagging hook, said snagging hook being sized and shaped to engage either of a chisel cut and a perforation in a film bag from said roll of film bags as said bag is withdrawn from said dispenser.

2. The clamshell dispenser for roll mounted film bags, as described in claim 1, further comprising a latching mechanism, said latching mechanism securing said retaining bracket in said first upper position.

3. The clamshell dispenser for roll mounted film bags, as described in claim 2, wherein said latching mechanism comprises a protruding tab, said tab being affixed to said retaining bracket and a latch, said latch being pivotally mounted to one of said at least one first side travel limiter and said at least one second side travel limiter and having a notch, said notch being sized and shaped to removably engage said protruding tab.

4. The clamshell dispenser for roll mounted film bags, as described in claim 1, wherein said retaining bracket further comprises a spring, said spring urging said bracket toward said first, upper position.

5. The clamshell dispenser for roll mounted film bags, as described in claim 1, further comprising a bag stream guide, said guide being attached to said retaining bracket.

6. The clamshell dispenser for roll mounted film bags, as described in claim 1, further comprising a downward facing snagging hook, said downward facing snagging hook being attached to said retaining bracket.

7. The clamshell dispenser for roll mounted film bags, as described in claim 1, wherein said planar base is attached to a fixture for mounting to a horizontal surface.

8. The clamshell dispenser for roll mounted film bags, as described in claim 1, wherein said planar base is attached to a fixture for mounting to either of a vertical or angled surface.

9. The clamshell dispenser for roll mounted film bags, as described in claim 1, wherein said planar base further comprises at least one aperture for mounting said base to a fixture.

10. The clamshell dispenser for roll mounted film bags, as described in claim 1, wherein said retaining bracket is curved to reduce a height of said dispenser.

11. The clamshell dispenser for roll mounted film bags, as described in claim 1, wherein at least one of said at least one first side travel limiter and at least one said at least one second side travel limiter is curved to reduce a height of said dispenser.

12. The clamshell dispenser for roll mounted film bags, as described in claim 1, further comprising a rearward motion limiter, said rearward motion limiter being attached to said planar base.

13. The clamshell dispenser for roll mounted film bags, as described in claim 12, wherein said rearward motion limiter is a member extending upwardly from a point adjacent a rear edge of said planar base.

14. The clamshell dispenser for roll mounted film bags, as described in claim 13, wherein an upper end of said rearward motion limiter is curved outwardly from said rear edge of said planar base to assist in insertion of said roll of film bags into said dispenser.

15. The clamshell dispenser for roll mounted film bags, as described in claim 1, wherein at least one of said at least one first side travel limiter and said at least one second side travel limiter is curved outwardly from either of said first side and said second side of said planar base, respectively, to assist in insertion of said roll of film bags.

16. The clamshell dispenser for roll mounted film bags, as described in claim 1, wherein at least one upper end of said retaining bracket is curved outwardly from a center of said planar base to assist in insertion of said roll of film bags into said dispenser.

17. An adapter for a bin, said bin having:

a support enclosure for a roll of film bags, said bin having a half round cylindrical wall, first and second vertical side walls;

a supporting rim, said rim disposed orthogonally to front edges of said side walls and upper and lower edges of said cylindrical wall and having spaced apertures for mounting said bin to a surface;

said surface having an opening sized and shaped to permit passage of outer surfaces of said walls but not said supporting rim;

said vertical side walls having first and second integral channels, said channels providing an entry point and support for either of a rod, said rod being sized and shaped to support said roll of bags in said bin, and an adapter for a bin;

said adapter comprising:

first and second bag dispensers for folded roll mounted film bags, each of said dispensers comprising:

a planar base, said base having a first side and a second side and being sized and shaped to fit beneath a roll of said film bags and being mounted to a fixture;

at least one first side travel limiter, said first side limiter attached to said planar base adjacent said first side and limiting movement of said roll of film bags toward said first side;

at least one second side travel limiter, said second side limiter attached to said planar base adjacent said second side and limiting movement of said roll of film bags toward said second side;

a bag roll tray, said bag roll tray having a vertical portion, said vertical portion being attached to said planar base, a U-shaped portion extending from said vertical portion and spaced apart from said planar base and a horizontal portion extending from said U-shaped portion and spaced above said planar base, said bag roll tray being sized and shaped to fit between said at least one first side travel limiter and said at least one second side travel limiter, said U-shaped portion in contact with said horizontal portion forming a concave shape to accept a lower surface of a bag roll, thereby stabilizing said roll in said dispenser;

a retaining bracket, said retaining bracket being hingedly mounted adjacent a front edge of said planar base and being sized and shaped to prevent said roll of film bags from moving outwardly from said dispenser when said bracket is disposed in a first, upper position;

said retaining bracket being movable to a second, lower position for introduction of said roll into said dispenser; and an upward facing snagging hook, said snagging hook being sized and shaped to engage either of a chisel cut and a perforation in a film bag from said roll of film bags as said bag is withdrawn from said dispenser;

said fixture comprising a planar surface, said surface being sized and shaped to fit at least partially within said bin;

a first axle, said first axle being mounted orthogonally adjacent a first side edge of said fixture;

a second axle, said second axle being mounted orthogonally adjacent a second side edge of said fixture;

said first axle being mounted coaxially with said second axle; and first and second positioning wheels, said positioning wheels being mounted to said first and second axles and disposed to slidably engage said first and second integral channels with a bottom surface of said fixture disposed adjacent a lower portion of said cylindrical wall of said bin.

18. The adapter for a bin, as described in claim 17, wherein said dispensers further comprise at least one aperture penetrating said planar base for mounting said base to said fixture.

19. The adapter for a bin, as described in claim 17, wherein said dispensers further comprise a latching mechanism, said latching mechanism securing said retaining bracket in said first upper position.

20. The adapter for a bin, as described in claim 19, wherein said latching mechanism comprises a protruding tab, said tab being affixed to said retaining bracket and a latch, said latch being pivotally mounted to one of said at least one first side travel limiter and said at least one second side travel limiter and having a notch, said notch being sized and shaped to removably engage said protruding tab.

21. The adapter for a bin, as described in claim 17, wherein said retaining bracket further comprises a spring, said spring urging said bracket toward said first, upper position.

22. The adapter for a bin, as described in claim 17, wherein said dispensers further comprise a bag stream guide, said guide being attached to said retaining bracket.

23. The adapter for a bin, as described in claim 17, wherein said dispensers further comprise a downward facing snagging hook, said downward facing snagging hook being attached to said retaining bracket.

24. The adapter for a bin, as described in claim 17, wherein said retaining bracket is curved to reduce a height of said dispenser.

25. The adapter for a bin, as described in claim 17, wherein at least one of said at least one first side travel limiter and at least one of said at least one second side travel limiter is curved to reduce a height of said dispenser.

26. The adapter for a bin, as described in claim 17, wherein said dispensers further comprise a rearward motion limiter, said rearward motion limiter being attached to said planar base.

27. The adapter for a bin, as described in claim 26, wherein said rearward motion limiter is a member extending upwardly from a point adjacent a rear edge of said planar base.

28. The adapter for a bin, as described in claim 17, further comprising a bracket, said bracket being sized and shaped to secure said adapter to said bin.

29. The adapter for a bin, as described in claim 17, wherein said bracket is an angled, rigid member sized and shaped to bear upon an upper surface of said fixture.

* * * * *